US012527354B2

(12) United States Patent
Qiu

(10) Patent No.: US 12,527,354 B2
(45) Date of Patent: Jan. 20, 2026

(54) ATOMIZER AND AEROSOL GENERATION DEVICE

(71) Applicant: CHANGZHOU PATENT ELECTRONIC TECHNOLOGY CO., LTD, Changzhou (CN)

(72) Inventor: Weihua Qiu, Changzhou (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 825 days.

(21) Appl. No.: 17/857,058

(22) Filed: Jul. 4, 2022

(65) Prior Publication Data

US 2022/0330615 A1 Oct. 20, 2022

Related U.S. Application Data

(63) Continuation-in-part of application No. PCT/CN2020/142201, filed on Dec. 31, 2020.

(30) Foreign Application Priority Data

Jan. 4, 2020 (CN) ..... 202010007385.X
Jan. 4, 2020 (CN) ..... 202020012394.3

(51) Int. Cl.
*A24F 40/46* (2020.01)
*A24F 40/42* (2020.01)
*A24F 40/485* (2020.01)

(52) U.S. Cl.
CPC ..... *A24F 40/46* (2020.01); *A24F 40/42* (2020.01); *A24F 40/485* (2020.01)

(58) Field of Classification Search
CPC ..... A24F 40/48; A24F 40/44; A24F 40/40; A24F 40/10
See application file for complete search history.

(56) References Cited

U.S. PATENT DOCUMENTS

2014/0360516 A1* 12/2014 Liu ..... A61M 15/06 131/329
2015/0184846 A1 7/2015 Liu
(Continued)

FOREIGN PATENT DOCUMENTS

CN 206687179 U 12/2017
CN 109007980 A 12/2018
(Continued)

OTHER PUBLICATIONS

International Search Report of PCT Patent Application No. PCT/CN2020/142201 issued on Apr. 2, 2021.

*Primary Examiner* — Alex B Efta
(74) *Attorney, Agent, or Firm* — Andrew C. Cheng

(57) ABSTRACT

An atomizer includes a liquid storage member and an atomizing assembly. A liquid storage chamber used to store an aerosol-forming substrate is provided in the liquid storage member. The atomizing assembly is slidably connected to the liquid storage member, and includes a heating structure. The atomizing assembly is provided with a liquid inlet. A sealing member is installed in the liquid inlet. An abutting rod is provided within the liquid storage member and is fixed relative to the liquid storage member. The abutting rod is connected to the sealing member. Sliding the atomizing assembly relative to the liquid storage member enables the atomizing assembly to move between a first position and a second position. When the atomizing assembly is in the first position, the sealing member closes the liquid inlet. When the atomizing assembly is in the second position, the sealing member is separated from the liquid inlet.

16 Claims, 7 Drawing Sheets

(56) References Cited

U.S. PATENT DOCUMENTS

| | | | | |
|---|---|---|---|---|
| 2018/0000156 | A1* | 1/2018 | Qiu | A24F 40/40 |
| 2018/0289068 | A1 | 10/2018 | Liao et al. | |

FOREIGN PATENT DOCUMENTS

| | | | |
|---|---|---|---|
| CN | 110051044 | A | 7/2019 |
| CN | 209518261 | U | 10/2019 |
| CN | 209807140 | U | 12/2019 |
| CN | 211672451 | U | 10/2020 |

* cited by examiner

ATOMIZER AND AEROSOL GENERATION DEVICE

CROSS-REFERENCE TO RELATED APPLICATIONS

The present disclosure is a continuation-in-part of International Patent Application No. PCT/CN2020/142201, filed on Dec. 31, 2020, which claims priority to Chinese Patent Application Nos. 202010007385.X and 202020012394.3, both filed on Jan. 4, 2020. All of the aforementioned patent applications are hereby incorporated by reference in their entireties.

TECHNICAL FIELD

The present disclosure relates to the technical field of simulated smoking, in particular to an atomizer and an aerosol generating device.

BACKGROUND

The aerosol generating device includes an atomizer and a power supply device electrically connected to the atomizer. During operation, the atomizer heats the aerosol-forming substrate (for example, e-liquid, paste, tobacco, etc.) under the electric driving of the power supply device, so as to atomize the aerosol-forming substrate to generate smoke for being inhaled by the user.

At present, the heating member in the liquid storage atomizer is always in contact with the e-liquid during the period from the factory to the time before the user uses it, which may easily lead to the deterioration of the e-liquid. Moreover, when the liquid absorption of the heating member reaches saturation, the leakage of e-liquid is easily to occur, and the user experience is reduced.

SUMMARY

Based on this, it is necessary to provide an atomizer that can realize isolation of the aerosol-forming substrate from the heating structure.

It is also necessary to provide an aerosol generating device with the atomizer.

The technical solution adopted by the present disclosure to solve the problem is as follows: an atomizer includes a liquid storage member and an atomizing assembly, wherein the liquid storage member is provided with a liquid storage chamber for storing an aerosol-forming substrate, the atomizing assembly is slidably connected with the liquid storage member, the atomizing assembly includes a heating structure for heating the aerosol-forming substrate, the atomizing assembly is provided with a liquid inlet, a sealing member is installed in the liquid inlet, an abutting rod is provided in the liquid storage member and is fixed relative to the liquid storage member, the abutting rod is connected to the sealing member, sliding the atomizing assembly relative to the liquid storage member enables the atomizing assembly to move between a first position and a second position; when the atomizing assembly is in the first position, the sealing member closes the liquid inlet; when the atomizing assembly is in the second position, the sealing member is separated from the liquid inlet, and the aerosol-forming substrate comes into contact with the heating structure after passing through the liquid inlet.

Further, the atomizing assembly includes an atomizing bracket, the atomizing bracket is sealed with and slidably connected to the liquid storage member, the atomizing bracket is provided with a receiving chamber in communication with the liquid inlet, the heating structure is installed in the receiving chamber, the liquid inlet is provided at one end of the atomizing bracket adjacent to the liquid storage chamber.

Further, the atomizer further includes a bottom cover, the bottom cover is fixedly connected with the liquid storage member, the bottom cover is located at one end of the atomizing assembly away from the liquid storage chamber, one end of the abutting rod abuts against the bottom cover, the other end of the abutting rod passes through the atomizing bracket and is connected with the sealing member.

Further, there are two liquid inlets, the two liquid inlets are symmetrically arranged with respect to a central axis of the atomizing bracket.

Further, the heating structure is arranged at a lower end of the receiving chamber, a top wall of the receiving chamber corresponding to the heating structure protrudes toward the heating structure to form an arc surface.

Further, the atomizer further includes a movable member, one end of the movable member is connected to the atomizing bracket, the other end of the movable member extends to the outside of the liquid storage member, by moving the movable member, the atomizing assembly is driven to move from the first position to the second position under the driving of the movable member.

Further, wherein the movable member includes a vent tube and a mouthpiece connected with each other, the vent tube is connected with the atomizing bracket, the mouthpiece is slidably sleeved on the outside of the liquid storage member, a first fixing structure and a second fixing structure are provided between the liquid storage member and the mouthpiece; when the mouthpiece is fixed with the liquid storage member under the action of the first fixing structure, the atomizing assembly is located in the first position; when the mouthpiece is fixed with the liquid storage member under the action of the second fixing structure, the atomizing assembly is located in the second position.

Further, the atomizing assembly further includes an atomizing base, the atomizing base is connected with the atomizing bracket, the atomizing base is arranged away from the liquid storage chamber relative to the atomizing bracket, the atomizing base is provided with an atomizing chamber, the movable member is provided with a smoke outlet channel, and the atomizing chamber is in communication with the smoke outlet channel.

Further, an air inlet is provided at the bottom of the atomizing base, the air inlet is in communication with the outside atmosphere and the atomizing chamber, a side wall of the atomizing base is provided with an air vent hole in communication with the atomizing chamber, a side wall of the atomizing bracket is provided with a communication hole, the communication hole is in communication with the air vent hole and the smoke outlet channel.

Further, the atomizer further includes a movable member connected with the atomizing assembly, when the movable member is caused to slide down relative to the liquid storage member, the atomizing assembly is driven by the movable member to also slide down relative to the liquid storage member and move from the first position to the second position.

Further, the atomizer further includes a bottom cover, the bottom cover is located at one end of the atomizing assembly away from the liquid storage chamber and fixedly connected with the liquid storage member, the abutting rod passes through the atomizing assembly, with one end of the abutting rod abutting against the bottom cover and the other end of the abutting rod connected with the sealing member.

Further, the atomizing assembly includes an atomizing bracket and an atomizing base connected with each other, the atomizing bracket is arranged adjacent to the liquid storage chamber, the atomizing base is arranged away from the liquid storage chamber relative to the atomizing bracket, the heating structure is sandwiched between the atomizing bracket and the atomizing base, the liquid inlet is provided at one end of the atomizing bracket adjacent to the liquid storage chamber.

Further, the movable member includes a vent tube and a mouthpiece, a lower end of the vent tube extends into the liquid storage member and is fixedly connected with the atomizing bracket, an upper end of the vent tube extends to the outside of the liquid storage member and is fixedly connected with the mouthpiece, the mouthpiece is slidably sleeved on the outside of the liquid storage member.

Further, a first fixing structure and a second fixing structure are provided between the liquid storage member and the mouthpiece; when the mouthpiece is fixed with the liquid storage member by the first fixing structure, the atomizing assembly is located in the first position; when the mouthpiece is fixed with the liquid storage member by the second fixing structure, the atomizing assembly is located in the second position.

Further, when the atomizing assembly is in the first position, there is a gap between the end surface of the bottom cover adjacent to the liquid storage chamber and the end surface of the atomizing base away from the liquid storage chamber, wherein the gap is configured to provide room for the atomizing assembly to move; when the atomizing assembly is in the second position, the end face of the atomizing base away from the liquid storage chamber abuts against the end face of the bottom cover adjacent to the liquid storage chamber.

Further, a through hole is provided at the center of the bottom cover, a protrusion is protruded at the end surface of the atomizing base away from the liquid storage chamber, the protrusion matches with the through hole and is slidably connected with the through hole.

An aerosol generating device includes the atomizer as described above, and a power supply device electrically connected to the atomizer.

The beneficial effects of the present disclosure are as follows:

For the atomizer or aerosol generating device provided by the present disclosure, when the atomizing assembly is in the first position, the sealing member closes the liquid inlet, the aerosol-forming substrate cannot flow out of the liquid storage chamber, so as to avoid the leakage of the aerosol-forming substrate and also prevent the deterioration of the aerosol-forming substrate. When the atomizing assembly is in the second position, the sealing member is separated from the liquid inlet, so that the aerosol-forming substrate can come into contact with the heating structure after passing through the liquid inlet, and the user can perform normal suction operation, which is simple and convenient, and improves the user experience.

BRIEF DESCRIPTION OF THE DRAWINGS

The following further describes the present disclosure with reference to the drawings and embodiments.

Figure 1:
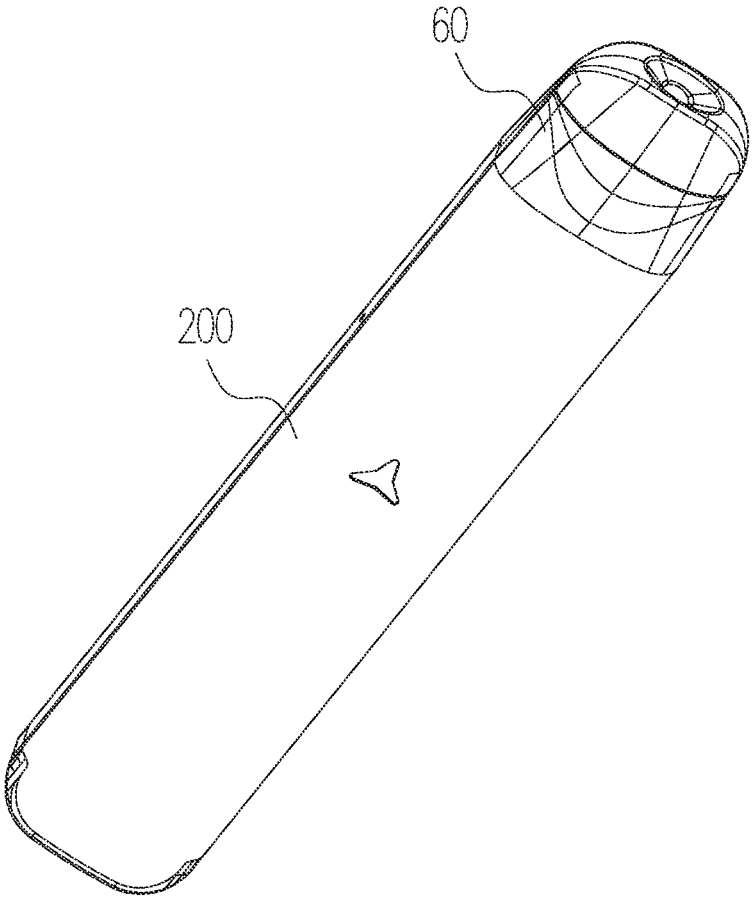
FIG. 1 is a perspective view of the aerosol generating device of the present disclosure.

The part names and reference signs thereof in the figures are as follows:

| | | |
|---|---|---|
| Atomizer 100 | Liquid storage member 10 | Liquid storage chamber 101 |
| Perforation 102 | First fixing structure 103 | Second fixing structure 104 |
| Atomizing assembly 20 | Receiving chamber 201 | Liquid inlet 202 |
| Heating structure 21 | Atomizing bracket 22 | Through hole 501 |
| First sealing member 221 | Air outlet 223 | Communication hole 224 |
| Atomizing base 23 | Atomizing chamber 231 | Connecting plate 232 |
| Mounting chamber 233 | Air inlet 234 | Air vent hole 235 |
| Sealing ring 236 | Second sealing ember 24 | Mounting groove 241 |
| Communication groove 242 | Conductive member 25 | Magnetic member 26 |
| Sealing member 30 | Abutting rod 40 | Bottom cover 50 |
| Protrusion 237 | Movable member 60 | Vent tube 61 |
| Mouthpiece 62 | Third sealing member 611 | Power supply device 200 |
| Battery housing 210 | Smoke outlet passage 601 | |

DETAILED DESCRIPTION OF PREFERRED EMBODIMENTS

The present disclosure will now be described in detail with reference to the drawings. This figure is a simplified schematic diagram, which only illustrates the basic structure of the present disclosure in a schematic manner, so it only shows the structure related to the present disclosure.

Figure 2:
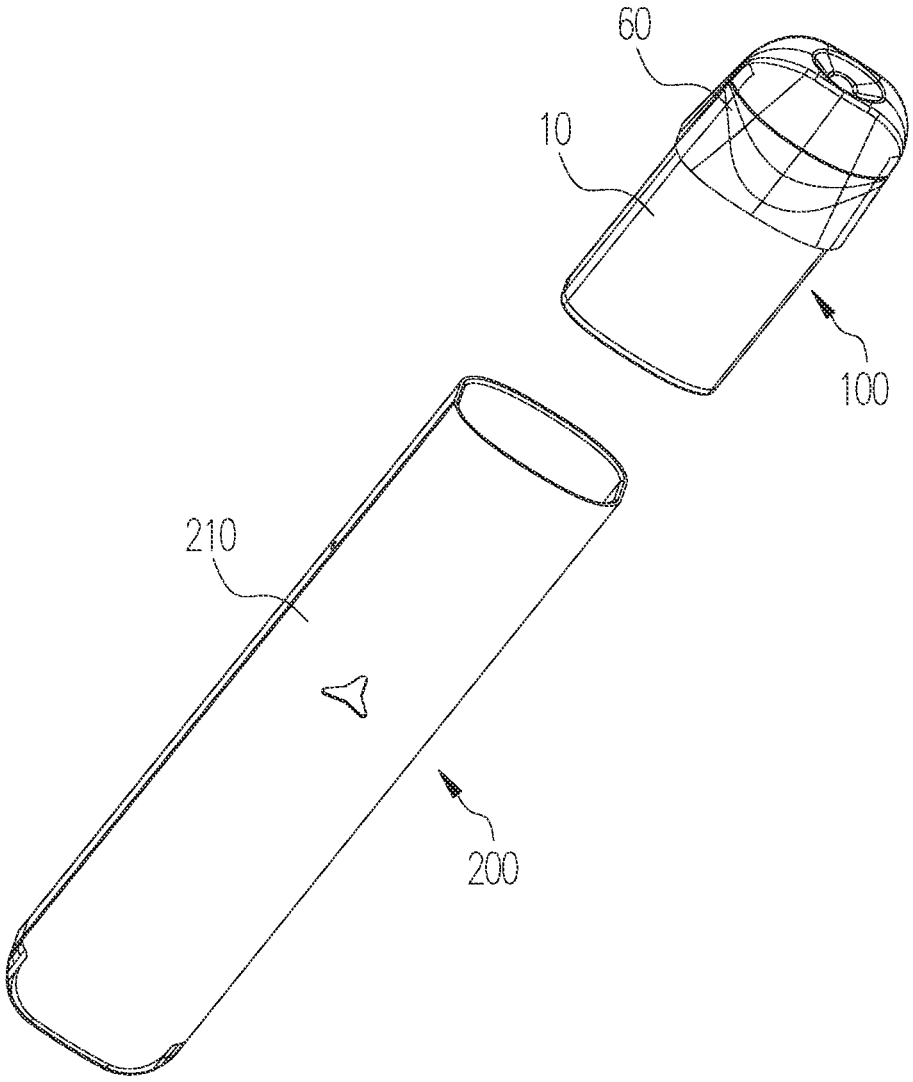
FIG. 2 is a partially exploded view of the aerosol generating device shown in FIG. 1.

Please refer to FIG. 1 and FIG. 2, the present disclosure provides an aerosol generating device, which includes an atomizer 100 and a power supply device 200 electrically connected to the atomizer 100. In use, the power supply device 200 supplies power to the atomizer 100, so that the aerosol-forming substrate generates smoke under the heating action of the atomizer 100 for the user to inhale.

Please refer to FIGS. 3-7, the atomizer 100 includes a liquid storage member 10 and an atomizing assembly 20. The liquid storage member 10 is provided with a liquid storage chamber 101 for storing the aerosol-forming substrate. The atomizing assembly 20 is slidably connected with the liquid storage member 10. The atomizing assembly 20 includes a heating structure 21 for heating the aerosol-forming substrate. The atomizing assembly 20 is provided with a liquid inlet 202, and a sealing member 30 is installed at the liquid inlet 202. An abutting rod 40 is fixedly arranged in the liquid storage member 10. The abutting rod 40 is connected with the sealing member 30. Sliding the atomizing assembly 20 relative to the liquid storage member 10 can make the atomizing assembly 20 move between a first position and a second position. When the atomizing assembly 20 is in the first position, the sealing member 30 closes the liquid inlet 202; when the atomizing assembly 20 is in the second position, the sealing member 30 is separated from the liquid inlet 202, such that the aerosol-forming substrate contacts the heating structure 21 after passing through the liquid inlet 202.

During the time period from the production of the atomizer 100 to the time before the user uses it, the sealing member 30 is in the first position, and at this time period, the aerosol-forming substrate cannot pass through the liquid inlet 202 due to the blocking of the sealing member 30, and thus cannot contact with the heating structure 21, thereby avoiding the deterioration of the aerosol-forming substrate and the leakage occurring when the heating structure 21 is saturated with liquid. In use, the atomizing assembly 20 moves from the first position to the second position, and at this time, the sealing member 30 is separated from the liquid inlet 202, the liquid inlet 202 is opened, the aerosol-forming substrate passes through the liquid inlet 202 and then comes into contact with the heating structure 21, and is then heated and atomized to generate smoke for being inhaled by the user.

Figure 6:
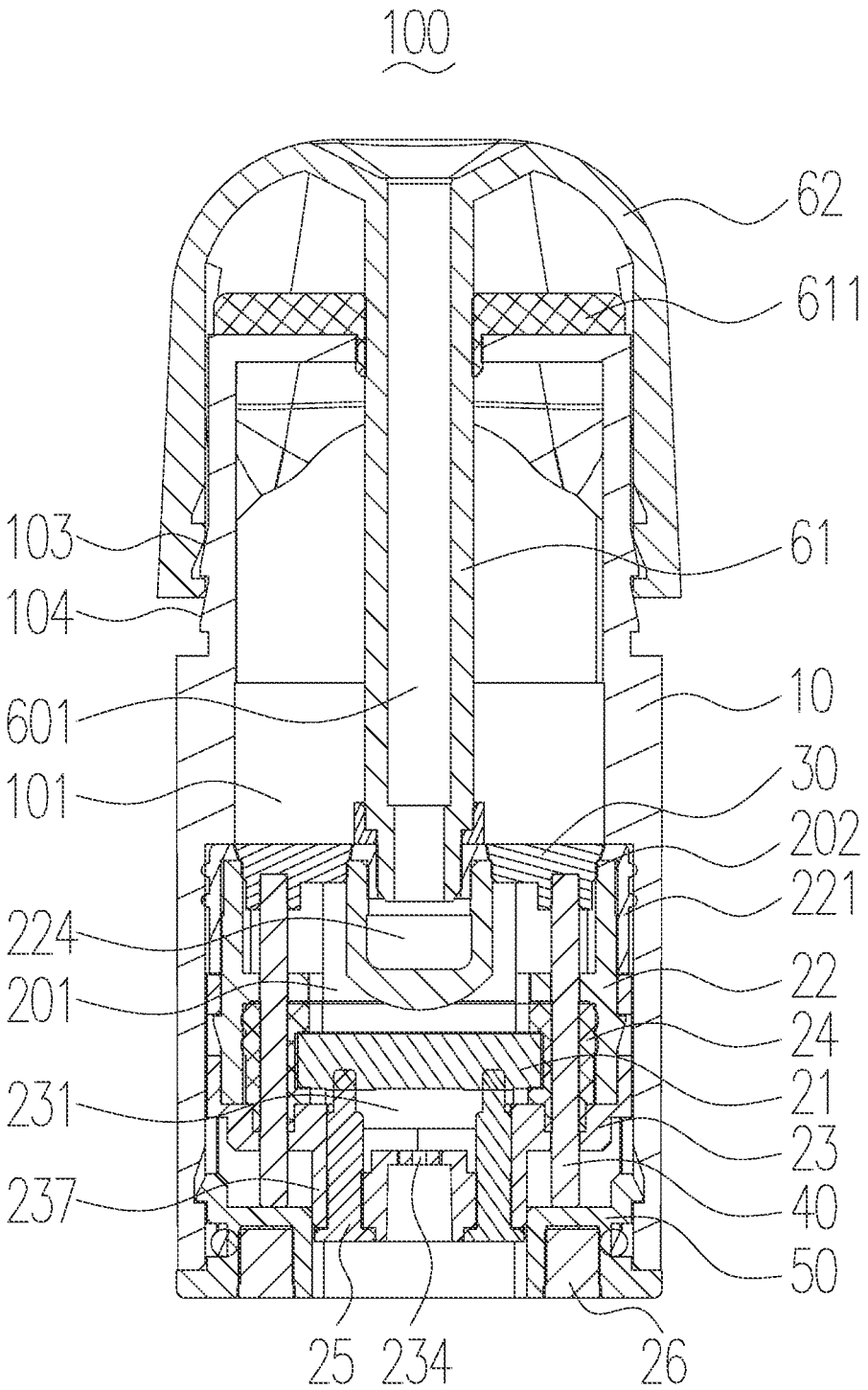
FIG. 6 is a cross-sectional view of the atomizer of the aerosol generating device shown in FIG. 2 (the liquid sealing member is in the first position)

Referring to FIG. 6, in a specific embodiment, the liquid storage member 10 is generally in the form of a hollow cylindrical structure with an opening at the lower end thereof, the liquid storage chamber 101 is formed by the inner cavity of the liquid storage member 10, the atomizing assembly 20 is accommodated in the lower end of the liquid storage member 10. The atomizing assembly 20 includes an atomizing bracket 22 and an atomizing base 23. The atomizing bracket 22 is connected with the atomizing base 23. The atomizing base 23 is provided with an atomizing chamber 231. The heating structure 21 is sandwiched between the atomizing bracket 22 and the atomizing base 23.

The atomizing bracket 22 is sealed with and slidably connected to the liquid storage member 10. The atomizing bracket 22 is arranged adjacent to the liquid storage chamber 101 relative to the atomizing base 23. The lower end of the atomizing bracket 22 is provided with an opening, and the opening of the atomizing bracket 22 forms a receiving chamber 201. The heating structure 21 is fixedly installed in the receiving chamber 201. The liquid inlet 202 is provided at one end of the atomizing bracket 22 adjacent to the liquid storage chamber 101, and the liquid inlet 202 is in communication with the receiving chamber 201. In this embodiment, there are two liquid inlets 202, and the two liquid inlets 202 are symmetrically arranged with respect to the central axis of the atomizing bracket 22. In this way, the aerosol-forming substrate in the liquid storage member 101 can enter into the receiving chamber 201 synchronously and uniformly through both sides of the atomizing bracket 22, so that the heating structure 21 can perform atomization more uniformly.

In a specific embodiment, in order to improve the sealing between the atomizing bracket 22 and the liquid storage member 10 and prevent the leakage of the aerosol-forming substrate, a first sealing member 221 is sleeved on the outside of the atomizing bracket 22, and the side wall of the first sealing member 221 is sandwiched between the atomizing bracket 22 and the liquid storage member 10. It can be understandable that the first sealing member 221 is made of silicone or rubber material.

The atomizing base 23 is arranged away from the liquid storage chamber 101 relative to the atomizing bracket 22. Specifically, one end of the atomizing base 23 facing the atomizing bracket 22 is opened, and the atomizing chamber 231 is formed by the opening of the atomizing base 23. After the heating structure 21 and the atomizing bracket 22 are installed in place, the heating structure 21 separates the liquid storage chamber 101 from the atomizing chamber 231, so that the aerosol-forming substrate stored in the liquid storage chamber 101 is completely isolated from the air in the atomizing chamber 231. Thus, the aerosol-forming substrate flowing into the receiving chamber 201 is prevented from directly flowing into the atomizing chamber 231 without passing through the heating structure 21, and the leakage of the aerosol-forming substrate is effectively prevented.

Figure 4:
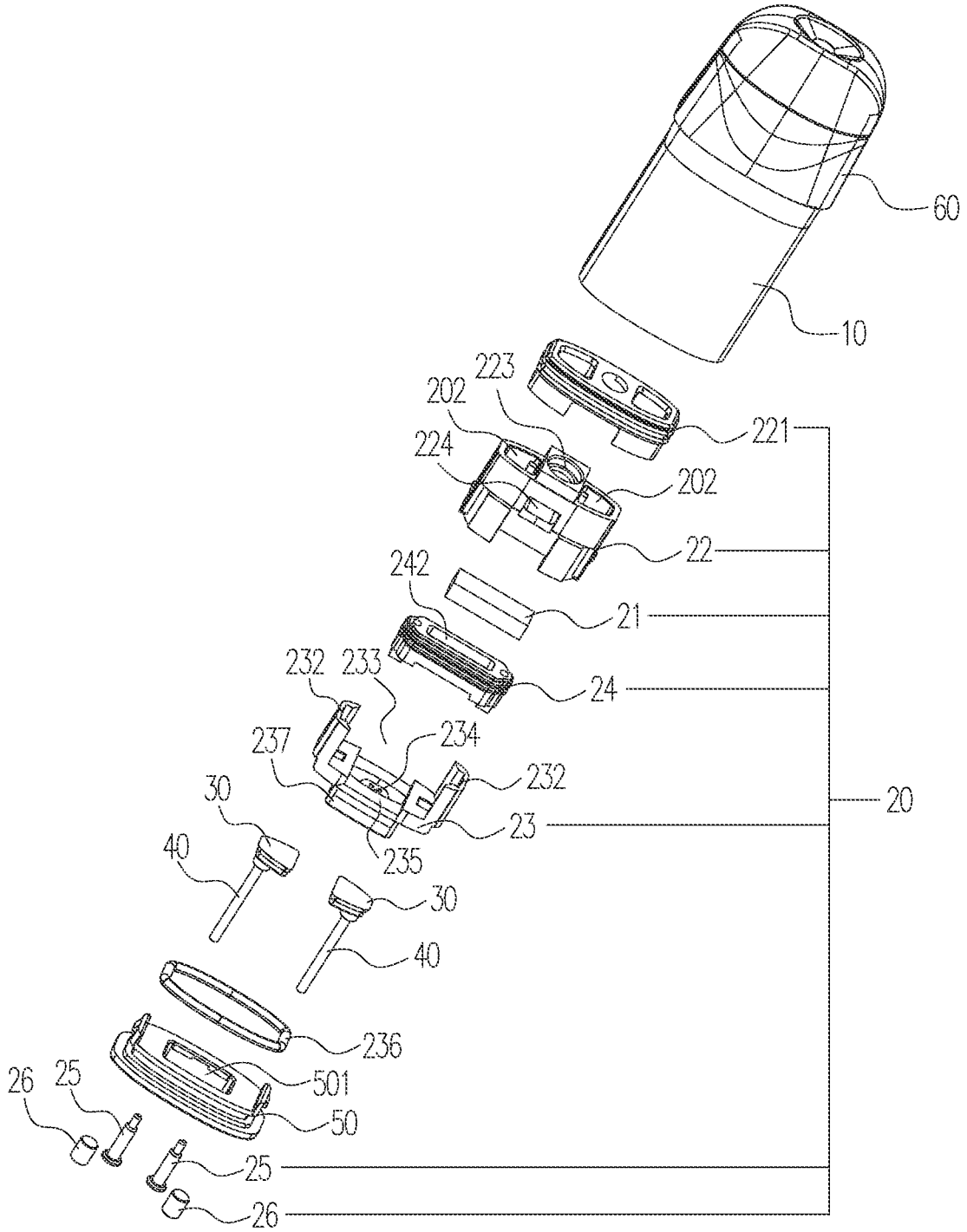
FIG. 4 is an exploded view of the atomizer of the aerosol generating device shown in FIG. 2.
Figure 5:
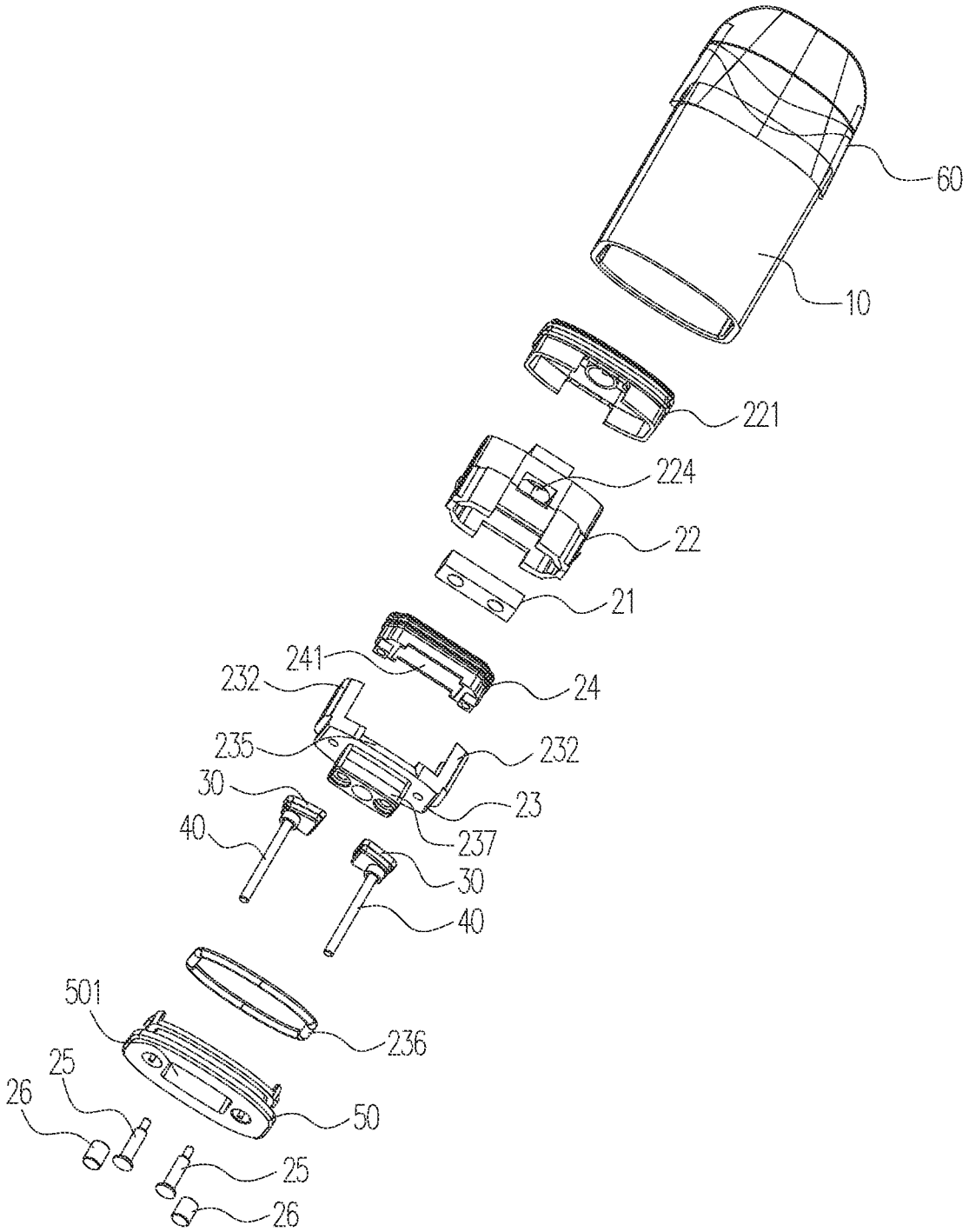
FIG. 5 is an exploded view of the atomizer of the aerosol generating device shown in FIG. 2 from another angle of view.

Please refer to FIG. 4 and FIG. 5, in a specific embodiment, the opposite sides of the surface of the atomizing base 23 facing the atomizing bracket 22 are protruded with two connecting plates 232 extending toward the atomizing bracket 22. The space between the two connecting plates 232 forms a mounting chamber 233, the mounting chamber 233 is configured for installing the atomizing bracket 22. Specifically, one end of the atomizing bracket 22 away from the liquid storage chamber 101 is inserted into the mounting chamber 233, the end face of the atomizing bracket 22 away from the liquid storage chamber 101 abuts against the end face of the atomizing base 23 adjacent to the liquid storage chamber 101, so as to realize the connection between the atomizing bracket 22 and the atomizing base 23 and facilitate the installation operation for the user. In addition, the connecting plates 232 and the atomizing bracket 22 are connected and fixed by a snap-fit structure.

The atomizing assembly 20 further includes a second sealing member 24, the second sealing member 24 is located in the lower end of the receiving chamber 201. A mounting groove 241 is provided at the end surface of the second sealing member 24 away from the liquid storage chamber 101. The heating structure 21 is installed in the mounting groove 241, so that the heating structure 21 is arranged at the tower end of the receiving chamber 201. The end surface of the second sealing member 24 adjacent to the liquid storage chamber 101 is provided with a communication groove 242 in communication with the mounting groove 241. The communication groove 242 is configured for the aerosol-forming substrate entering the receiving chamber 201 to enter the mounting groove 241 and be absorbed by the heating structure 21. It can be understood that the second sealing member 24 can be made of silicone or rubber material, so as to improve the sealing between the heating structure 21 and the atomizing bracket 22 and prevent the leakage of the aerosol-forming substrate.

Referring to FIG. 6 again, in a specific embodiment, the top wall of the receiving chamber 201 corresponding to the heating structure 21 protrudes toward the heating structure 21 to form an arc surface, so that when the aerosol-forming substrate flows into the receiving chamber 201, a portion of the aerosol-forming substrate can flow along the arc surface to the top of the heating structure 21 and drop onto the heating structure 211, which further ensures that ore aerosol-forming substrate can be absorbed by the heating structure 21 and heated and atomized to generate smoke.

The heating structure 21 includes a liquid absorbing member and a heating member in contact with each other, the liquid absorbing member is configured for absorbing the aerosol-forming substrate, and the heating member is configured for heating the aerosol-forming substrate.

In a specific embodiment, the liquid absorbing member is made of a porous ceramic material, and the porous ceramic material has high temperature resistance, which can effectively prevent the liquid absorbing member from being scorched and improve the user's suction taste. It can be understandable that the liquid absorbing member can also be porous graphite or foamed metal.

In a specific embodiment, the heating member is disposed at the lower surface of the liquid absorbing member. Under the electric driving of the power supply device 200, the aerosol-forming substrate conducted to the lower surface of the liquid absorbing member is heated, so that the aerosol-forming substrate is atomized to generate smoke, and the smoke fills the atomizing chamber 231. The heating member can be a heating coating, a heating circuit, a heating sheet or a heating net, and the like.

The atomizer 100 of the present disclosure further includes a bottom cover 50. The bottom cover 50 is fixedly connected with the liquid storage member 10. The bottom cover 50 is located at one end of the atomizing assembly 20 away from the liquid storage chamber 101. The abutting rod 40 extends along the axial direction of the liquid storage member 10, one end of the abutting rod 40 abuts against the bottom cover 50, and the other end of the abutting rod 40 passes through the atomizing base 23 and the atomizing bracket 22 in sequence and is fixedly connected with the sealing member 30. In this embodiment, the abutting rod 40 is inserted into the sealing member 30. In order to improve the sealing effect of the sealing member 30 for closing the liquid inlet 202 and prevent the leakage of the aerosol-forming substrate, the sealing member 30 is made of silicone or rubber material.

In a specific embodiment, the bottom cover 50 is snap-connected to the lower end of the liquid storage member 10. It can be understood that the bottom cover 50 and the liquid storage member 10 can also be connected in a detachable manner such as plug connection, screw connection or magnetic connection, which is not limited here. In addition, the bottom cover 50 is accommodated in the lower end of the liquid storage member 10. In order to improve the sealing between the bottom cover 50 and the liquid storage member 10 and prevent the aerosol-forming substrate from leaking, a sealing ring 236 is sandwiched between the outer wall of the bottom cover 50 and the inner wall of the liquid storage member 10. The sealing ring 236 can be made of a sealing material such as silicone or rubber.

Figure 7:
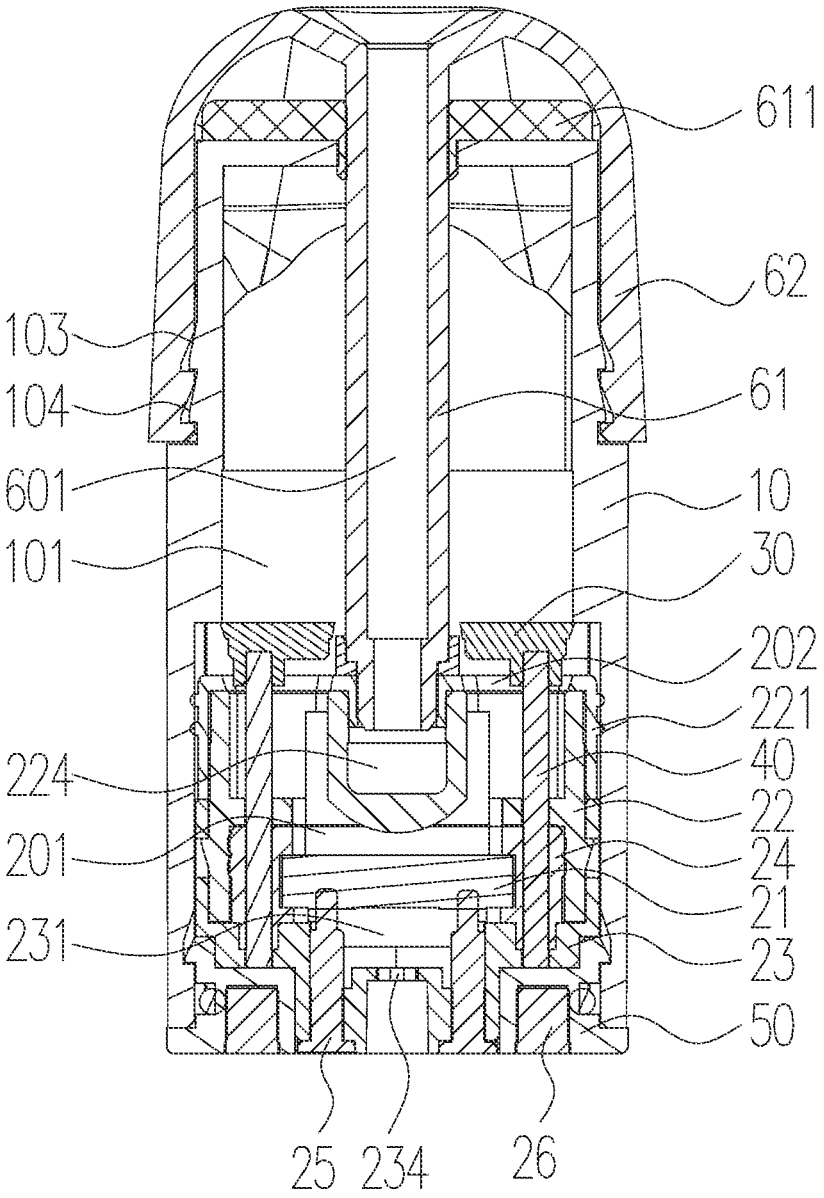
FIG. 7 is another cross-sectional view of the atomizer of the aerosol generating device shown in FIG. 2 (the liquid sealing member is in the second position).

Referring to FIG. 6, when the atomizing assembly 20 is in the first position, there is a gap between the end surface of the bottom cover 50 adjacent to the liquid storage chamber 101 and the end surface of the atomizing base 23 away from the liquid storage chamber 101. The gap can provide room for the atomizing assembly 20 to move. Referring to FIG. 7, the atomizing assembly 20 moves relative to the abutting rod 40 in a direction away from the liquid storage chamber 101, until the end face of the atomizing base 23 away from the liquid storage chamber 101 abuts against the end face of the bottom cover 50 adjacent to the liquid storage chamber 101, such that the atomizing assembly 20 is in the second position, and at the same time, the sealing member 30 is separated from the liquid inlet 202 under the driving action of the abutting rod 40.

Figure 3:
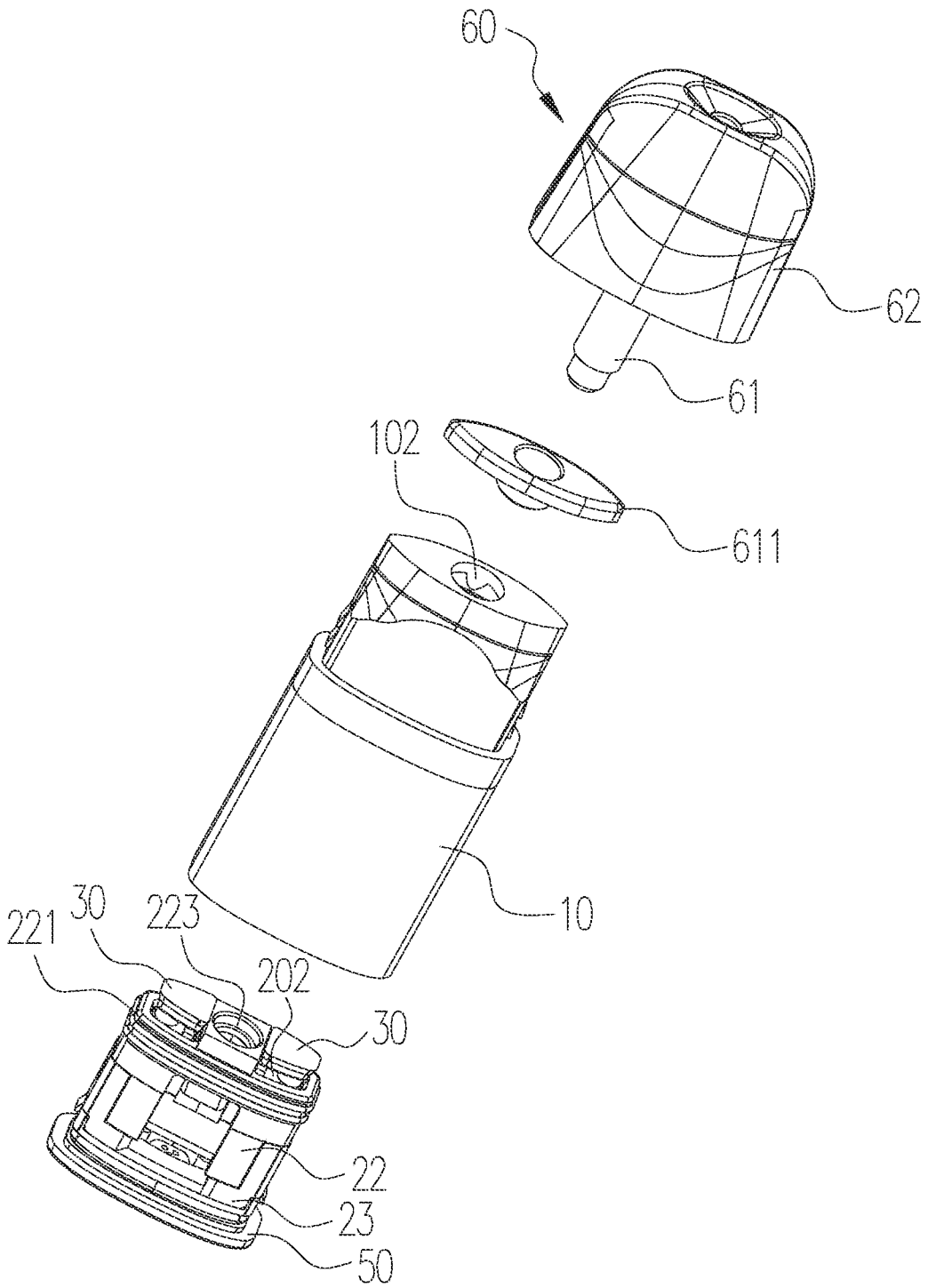
FIG. 3 is a partially exploded view of the atomizer of the aerosol generating device shown in FIG. 2.

Please refer to FIG. 3 and FIG. 6 again, the atomizer 100 of the present disclosure further includes a movable member 60, one end of the movable member 60 is connected to the atomizing assembly 20, and the other end of the movable member 60 extends to the outside of the liquid storage member 10. The atomizing assembly 20 can be driven to move by the movable member 60.

The movable member 60 includes a vent tube 61 and a mouthpiece 62 sleeved on the outside of the vent tube 61. The vent tube 61 is generally in the form of a tubular structure with two ends penetrating through. The lower end of the mouthpiece 62 is provided with an opening. The upper end of the vent tube 61 extends to the outside of the liquid storage member 10 and is connected to the upper end of the mouthpiece 62. The lower end of the vent tube 61 slidably passes through the top wall of the liquid storage member 10 along the axial direction of the liquid storage member 10 and then extends into the liquid storage member 10 and is fixedly connected to the atomizing bracket 22. The mouthpiece 62 is slidably sleeved on the outside of the upper end of the liquid storage member 10. In use, when the user presses the mouthpiece 62, the vent tube 61 moves downward under the driving of the mouthpiece 62, thereby driving the atomizing assembly 20 to move from the first position to the second position, which is simple and convenient to operate for the user.

In a specific embodiment, the top wall of the liquid storage member 10 is provided with a perforation 102, the vent tube 61 slidably passes through the perforation 102. In order to improve the tightness between the vent tube 61 and the liquid storage member 10 and prevent the leakage of the aerosol-forming substrate, a third sealing member 611 is sandwiched between the outer wall of the vent tube 61 and the hole wall of the perforation 102. It is understood that the third sealing member 611 is made of silicone or rubber material.

In addition, a first fixing structure 103 and a second fixing structure 104 are provided between the liquid storage member 10 and the mouthpiece 62 along the axial direction of the liquid storage member 10. The first fixing structure 103 is located above the second fixing structure 104. Both the first fixing structure 103 and the second fixing structure 104 can fix the liquid storage member 10 and the mouthpiece 62 to each other, so as to effectively prevent the mouthpiece 62 from moving easily. When the mouthpiece 62 is fixed with the liquid storage member 10 under the action of the first fixing structure 103, the atomizing assembly 20 is located in the first position. When the mouthpiece 62 slides down to be fixed with the liquid storage member 10 under the action of the second fixing structure 104, the atomizing assembly 20 moves from the first position to the second position under the driving of the vent tube 61. In this way, by arranging the first fixing structure 103 and the second fixing structure 104, the user's operation is facilitated. It can be understood that the first fixing structure 103 and the second fixing structure 104 can be a snap-fit structure or a magnetic adsorption structure, etc., which are not limited here.

Please refer to FIG. 3, FIG. 4 and FIG. 6 again, in a specific embodiment, an air inlet 234 is provided at the end surface of the atomizing base 23 away from the atomizing bracket 22. The air inlet 234 is in communication with the outside atmosphere and the atomizing chamber 231. The side wall of the atomizing base 23 is provided with an air vent hole 235 extending through the inner and outer side walls of the atomizing base 23. The air vent hole 235 is in communication with the atomizing chamber 231. An air outlet 223 is provided at the end surface of the atomizing bracket 22 adjacent to the liquid storage chamber 101. The air outlet 223 is a blind hole, a communication hole 224 is further provided at the side wall of the atomizing bracket 22, the communication hole 224 is in communication with the air vent hole 235 and the air outlet 223. Thus, when the user sucks, the external air enters the atomizing chamber 231 through the air inlet 234 to be mixed with the smoke, the mixed smoke passes through the air vent hole 235 and the communication hole 224 in sequence and then flows out from the air outlet 223.

In addition, the inner cavity of the vent tube 61 is provided with a smoke outlet channel 601. The smoke outlet channel 601 is in communication with the air outlet 223, so that the smoke can pass through the smoke outlet channel 601 and then enter the user's mouth. Specifically, the lower end of the vent tube 61 is inserted into the air outlet 223, so that the smoke outlet channel 601 is in communication with the atomizing chamber 231 through the communication hole 224. The airtight connection between the outer wall of the vent tube 61 and the hole wall of the air outlet 223 ensures the airtightness between the vent tube 61 and the atomizing bracket 22, prevents the leakage of the smoke, and also prevents the aerosol-forming substrate from entering the air outlet 223.

Please refer to FIG. 4 to FIG. 6, the atomizing assembly 20 further includes a conductive member 25, and the conductive member 25 is configured for conducting electricity. There are two conductive members 25, one of which is used as a positive electrode, and the other is used as a negative electrode. Specifically, the conductive member 25 is inserted into the atomizing base 23 from the lower end surface of the atomizing base 23, passes through the atomizing chamber 231 and then abuts against the heating structure 21 to realize the electrical connection between the conductive member 25 and the heating structure 21. In a specific embodiment, a through hole 501 is provided at the center of the bottom cover 50, a protrusion 237 is protruded at the end surface of the atomizing base 23 away from the liquid storage chamber 101, and the protrusion 237 matches with the through hole 501 and is slidably connected with the through hole 501. The conductive member 25 is installed on the protrusion 237, and the air inlet 234 is provided in the protrusion 237. It can be understood that the user can also operate the atomizing base 23 through the through hole 501 from the lower end of the atomizer 100, so as to realize the function of moving the atomizing assembly 20.

The atomizing assembly 20 further includes a magnetic member 26. The magnetic member 26 is configured to realize the magnetic connection between the atomizer 100 and the power supply device 200. Specifically, the magnetic member 26 is installed at the lower end surface of the atomizing base 23. In a specific embodiment, the magnetic member 26 is a magnet. The power supply device 200 includes a battery housing 210 and a battery installed in the battery housing 210. The battery housing 210 is connected to the liquid storage member 10, so as to realize the connection relationship between the power supply device 200 and the atomizer 100. It can be understood that the power supply device 200 and the atomizer 100 can also be connected by plug-in connection, screw connection, snapping connection, and so forth, which are not limited here. In addition, the battery is electrically connected to the heating member of the heating structure 21 through the conductive members 25.

In the atomizer 100 provided by the present disclosure, when the atomizing assembly 20 is in the first position, the sealing member 30 closes the liquid inlet 202, the aerosol-forming substrate cannot flow out of the liquid storage chamber 101, so as to avoid the leakage of the aerosol-forming substrate and also prevent the deterioration of the aerosol-forming substrate. When the atomizing assembly 20 is in the second position, the sealing member 30 is separated from the liquid inlet 202, so that the aerosol-forming substrate can come into contact with the heating structure 21 after passing through the liquid inlet 202, and the user can perform normal suction operation, which is simple and convenient, and improves the user experience.

Since the aerosol generating device provided by the present disclosure has all the technical features of the above-mentioned atomizer 100, it also has the same technical effects as the above-mentioned atomizer 100.

Taking the above-mentioned ideal embodiments according to the present disclosure as enlightenment, through the above description, the relevant persons can make various changes and modifications without departing from the concept of the present disclosure. The technical scope of the present disclosure is not limited to the content of the specification, and its technical scope should be determined according to the scope of the claims.

What is claimed is:

1. An atomizer, comprising a liquid storage member and an atomizing assembly, wherein the liquid storage member is provided with a liquid storage chamber for storing an aerosol-forming substrate, the atomizing assembly is slidably connected with the liquid storage member, the atomizing assembly comprises a heating structure for heating the aerosol-forming substrate, the atomizing assembly is provided with a liquid inlet, a sealing member is installed in the liquid inlet, an abutting rod is provided in the liquid storage member and is fixed relative to the liquid storage member, the abutting rod is connected to the sealing member, sliding the atomizing assembly relative to the liquid storage member enables the atomizing assembly to move between a first position and a second position; when the atomizing assembly is in the first position, the sealing member closes the liquid inlet; when the atomizing assembly is in the second position, the sealing member is separated from the liquid inlet, and the aerosol-forming substrate comes into contact with the heating structure after passing through the liquid inlet;

wherein the atomizer further comprises a movable member connected with the atomizing assembly, when the movable member is caused to slide down relative to the liquid storage member, the atomizing assembly is driven by the movable member to also slide down relative to the liquid storage member and move from the first position to the second position.

2. The atomizer according to claim 1, wherein the atomizing assembly comprises an atomizing bracket, the atomizing bracket is sealed with and slidably connected to the liquid storage member, the atomizing bracket is provided with a receiving chamber in communication with the liquid inlet, the beating structure is installed in the receiving chamber, the liquid inlet is provided at one end of the atomizing bracket adjacent to the liquid storage chamber.

3. The atomizer according to claim 2, wherein the atomizer further comprises a bottom cover, the bottom cover is fixedly connected with the liquid storage member, the bottom cover is located at one end of the atomizing assembly away from the liquid storage chamber, one end of the abutting rod abuts against the bottom cover, the other end of the abutting rod passes through the atomizing bracket and is connected with the sealing member.

4. The atomizer according to claim 2, wherein there are two liquid inlets, the two liquid inlets are symmetrically arranged with respect to a central axis of the atomizing bracket.

5. The atomizer according to claim 2, wherein the heating structure is arranged at a lower end of the receiving chamber, a top wall of the receiving chamber corresponding to the heating structure protrudes toward the heating structure to form an arc surface.

6. The atomizer according to claim 2, wherein one end of the movable member is connected to the atomizing bracket, the other end of the movable member extends to the outside of the liquid storage member, by moving the movable member, the atomizing assembly is driven to move from the first position to the second position under the driving of the movable member.

7. The atomizer according to claim 6, wherein the movable member comprises a vent tube and a mouthpiece connected with each other, the vent tube is connected with the atomizing bracket, the mouthpiece is slidably sleeved on the outside of the liquid storage member, a first fixing structure and a second fixing structure are provided between the liquid storage member and the mouthpiece; when the mouthpiece is fixed with the liquid storage member under the action of the first fixing structure, the atomizing assembly is located in the first position; when the mouthpiece is fixed with the liquid storage member under the action of the second fixing structure, the atomizing assembly is located in the second position.

8. The atomizer according to claim 6, wherein the atomizing assembly further comprises an atomizing base, the atomizing base is connected with the atomizing bracket, the atomizing base is arranged away from the liquid storage chamber relative to the atomizing bracket, the atomizing base is provided with an atomizing chamber, the movable member is provided with a smoke outlet channel, and the atomizing chamber is in communication with the smoke outlet channel.

9. The atomizer according to claim 8, wherein an air inlet is provided at the bottom of the atomizing base, the air inlet is in communication with the outside atmosphere and the atomizing chamber, a side wall of the atomizing base is provided with an air vent hole in communication with the atomizing chamber, a side wall of the atomizing bracket is provided with a communication hole, the communication hole is in communication with the air vent hole and the smoke outlet channel.

10. The atomizer according to claim 1, wherein the atomizer further comprises a bottom cover, the bottom cover is located at one end of the atomizing assembly away from the liquid storage chamber and fixedly connected with the liquid storage member, the abutting rod passes through the atomizing assembly, with one end of the abutting rod abutting against the bottom cover and the other end of the abutting rod connected with the sealing member.

11. The atomizer according to claim 10, wherein the atomizing assembly comprises an atomizing bracket and an atomizing base connected with each other, the atomizing bracket is arranged adjacent to the liquid storage chamber, the atomizing base is arranged away from the liquid storage chamber relative to the atomizing bracket, the heating structure is sandwiched between the atomizing bracket and the atomizing base, the liquid inlet is provided at one end of the atomizing bracket adjacent to the liquid storage chamber.

12. The atomizer according to claim 11, wherein the movable member comprises a vent tube and a mouthpiece, a lower end of the vent tube extends into the liquid storage member and is fixedly connected with the atomizing bracket, an upper end of the vent tube extends to the outside of the liquid storage member and is fixedly connected with the mouthpiece, the mouthpiece is slidably sleeved on the outside of the liquid storage member.

13. The atomizer according to claim 12, wherein a first fixing structure and a second fixing structure are provided between the liquid storage member and the mouthpiece; when the mouthpiece is fixed with the liquid storage member by the first fixing structure, the atomizing assembly is located in the first position; when the mouthpiece is fixed with the liquid storage member by the second fixing structure, the atomizing assembly is located in the second position.

14. The atomizer according to claim 11, wherein when the atomizing assembly is in the first position, there is a gap between the end surface of the bottom cover adjacent to the liquid storage chamber and the end surface of the atomizing base away from the liquid storage chamber, wherein the gap is configured to provide room for the atomizing assembly to move; when the atomizing assembly is in the second position, the end face of the atomizing base away from the liquid storage chamber abuts against the end face of the bottom cover adjacent to the liquid storage chamber.

15. The atomizer according to claim 14, wherein a through hole is provided at the center of the bottom cover, a protrusion is protruded at the end surface of the atomizing base away from the liquid storage chamber, the protrusion matches with the through hole and is slidably connected with the through hole.

16. An aerosol generating device, comprising:

the atomizer according to claim 1; and a power supply device electrically connected to the atomizer.

* * * * *